US008396406B2

(12) United States Patent
Knapp et al.

(10) Patent No.: US 8,396,406 B2
(45) Date of Patent: Mar. 12, 2013

(54) APPARATUSES USEFUL IN PRINTING AND METHODS OF FIXING MARKING MATERIALS ON MEDIA

(75) Inventors: John F. Knapp, Fairport, NY (US); Shu Chang, Pittsford, NY (US)

(73) Assignee: Xerox Corporation

( * ) Notice: Subject to any disclaimer, the term of this patent is extended or adjusted under 35 U.S.C. 154(b) by 406 days.

(21) Appl. No.: 12/631,381

(22) Filed: Dec. 4, 2009

(65) Prior Publication Data

US 2011/0135349 A1 Jun. 9, 2011

(51) Int. Cl.
*G03G 15/20* (2006.01)

(52) U.S. Cl. ..... 399/320

(58) Field of Classification Search ..... 399/320, 399/328, 335, 339
See application file for complete search history.

(56) References Cited

U.S. PATENT DOCUMENTS 4,259,920 A * 4/1981 Sasaki ..... 118/116
4,334,471 A 6/1982 Noyes et al.
4,407,922 A 10/1983 Grushkin et al.
4,563,075 A * 1/1986 Mosholder ..... 399/339
5,045,422 A 9/1991 Kmiecik-Lawrynowicz et al.
6,795,661 B2 * 9/2004 Kanesawa et al. ..... 399/69
7,953,349 B2 * 5/2011 Fukai ..... 399/122
2006/0018688 A1 * 1/2006 Nakamura et al. ..... 399/336
2008/0075490 A1 * 3/2008 Ota et al. ..... 399/45
2009/0245896 A1 * 10/2009 Ishikake et al. ..... 399/328

* cited by examiner

*Primary Examiner* — Walter L Lindsay, Jr.
*Assistant Examiner* — Frederick Wenderoth
(74) *Attorney, Agent, or Firm* — Ronald E. Prass, Jr.; Prass LLP

(57) ABSTRACT

Apparatuses useful in printing and methods of fixing marking materials on media in apparatuses useful in printing are provided. An exemplary embodiment of the apparatuses useful in printing includes a first fixing device disposed along a first media path. The first fixing device includes a first fixing member including a first surface and a second fixing member including a second surface which forms a first nip with the first surface. The first fixing device does not include a thermal energy source that actively heats the first surface or the second surface and the first fixing device is adapted to apply pressure to a medium received at the first nip. A second fixing device is disposed along a second media path. The second fixing device includes at least one thermal energy source adapted to supply thermal energy to actively heat the medium at the second fixing device. A controller is configured to selectively route the medium to the first fixing device or to the second fixing device.

21 Claims, 5 Drawing Sheets

APPARATUSES USEFUL IN PRINTING AND METHODS OF FIXING MARKING MATERIALS ON MEDIA

BACKGROUND

In printing apparatuses, images are formed on media using a marking material. Such printing apparatuses can include a fixing device having a nip. Media are fed to the nip to fix the marking material onto the media.

It would be desirable to provide apparatuses useful in printing and corresponding methods that can provide reduced power consumption.

SUMMARY

Apparatuses useful in printing and methods of fixing marking materials on media are provided. An exemplary embodiment of the apparatuses useful in printing comprises a first fixing device disposed along a first media path, the first fixing device comprising a first fixing member including a first surface and a second fixing member including a second surface which forms a first nip with the first surface, wherein the first fixing device does not include a thermal energy source that actively heats the first surface or the second surface and the first fixing device is adapted to apply pressure to a medium received at the first nip; a second fixing device disposed along a second media path, the second fixing device including at least one thermal energy source adapted to supply thermal energy to actively heat the medium at the second fixing device; and a controller configured to selectively route the medium to the first fixing device or to the second fixing device.

DRAWINGS

DETAILED DESCRIPTION

Figure 1:
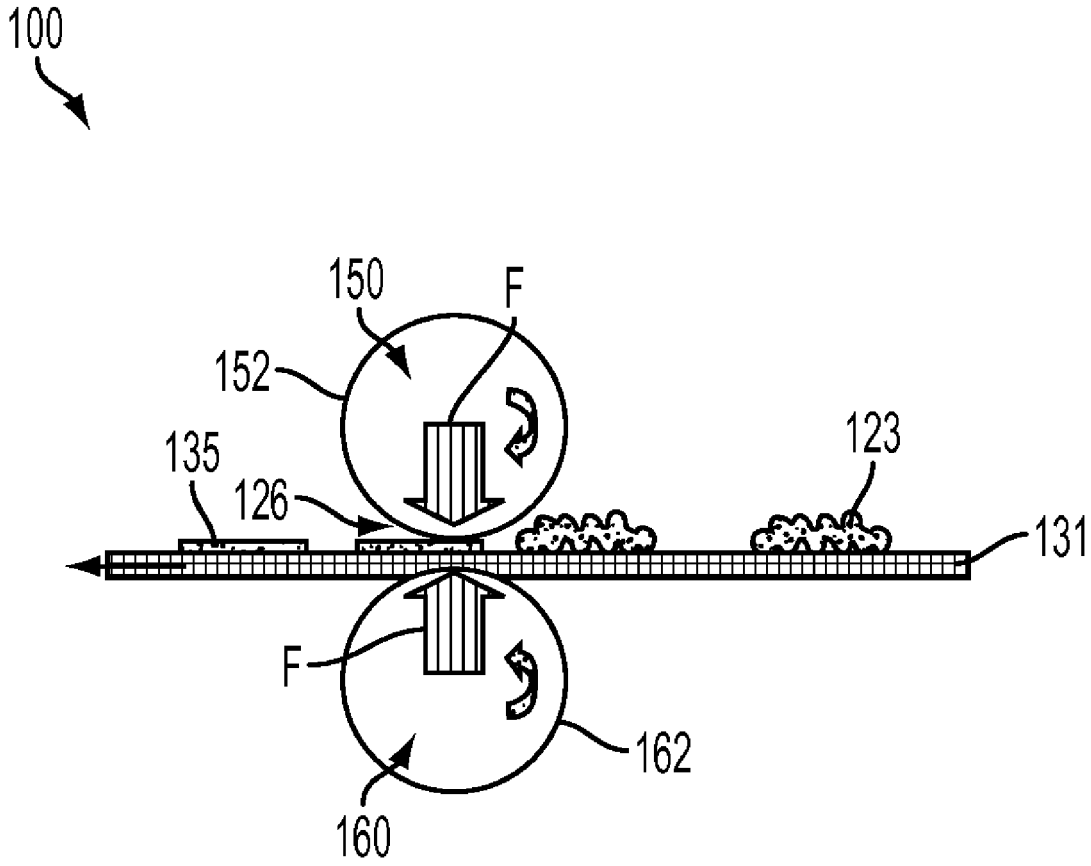
FIG. 1 depicts an exemplary embodiment of a fixing device which can fix marking material onto media using applied pressure.

The disclosed embodiments include apparatuses useful in printing comprising a first fixing device disposed along a first media path, the first fixing device comprising a first fixing member including a first surface and a second fixing member including a second surface which forms a first nip with the first surface, wherein the first fixing device does not include a thermal energy source that actively heats the first surface or the second surface and the first fixing device is adapted to apply pressure to a medium received at the first nip; a second fixing device disposed along a second media path, the second fixing device including at least one thermal energy source adapted to supply thermal energy to actively heat the medium at the second fixing device; and a controller configured to selectively route the medium to the first fixing device or to the second fixing device.

The disclosed embodiments further include an apparatus useful in printing comprising a first fixing device disposed along a media path, the first fixing device comprising a first fixing member including a first surface and a second fixing member including a second surface which forms a first nip with the first surface, wherein the first fixing device does not include a thermal energy source that actively heats the first surface or the second surface and the first fixing device is operable to apply pressure to a medium received at the first nip; a second fixing device disposed along the media path, the second fixing device including at least one thermal energy source adapted to supply thermal energy to actively heat the medium at the second fixing device; and a controller connected to the second fixing device and configured to selectively activate the at least one thermal energy source to supply thermal energy.

The disclosed embodiments further include a method of fixing a marking material onto a medium in an apparatus useful in printing. The method comprises selectively routing a medium having marking material thereon in the apparatus useful in printing to either: a first fixing device disposed along a first media path, the first fixing device comprising a first fixing member including a first surface and a second fixing member including a second surface which forms a first nip with the first surface, wherein the first fixing device does not include a thermal energy source that actively heats the first surface or the second surface and the first fixing device applies pressure to the marking material at the first nip to fix the marking material onto the medium when the medium is routed to the first fixing device; or a second fixing device disposed along a second media path, the second fixing device including at least one thermal energy source which supplies thermal energy to thermally fix the marking material onto the medium when the medium is routed to the second fixing device.

The disclosed embodiments further include a method of fixing marking material onto a medium in an apparatus useful in printing. The apparatus comprises a first fixing device and a second fixing device arranged along a media path with the first fixing device, the first fixing device including a first fixing member having a first surface and a second fixing member having a second surface which forms a first nip with the first surface, wherein the first fixing device does not include a thermal energy source that actively heats the first surface or the second surface, the second fixing device including at least one thermal energy source. The method comprises feeding a medium having a marking material on a surface thereof along the media path to the first nip to pressure fix the marking material onto the medium; feeding the medium along the media path to the second fixing device; and optionally supplying thermal energy from the at least one thermal energy source to the medium to thermally fix the marking material onto the medium at the second fixing device.

As used herein, the term "printing apparatus" encompasses any apparatus that performs a print outputting function for any purpose. Such apparatuses can include, e.g., printers, copiers, facsimile machines, bookmaking machines, multifunction machine, and the like. The printing apparatuses can use various types of solid and liquid marking materials, including toners and inks (e.g., liquid inks, gel inks, heat-curable inks and radiation-curable inks), and the like. The printing apparatuses can use various thermal, pressure and other conditions to treat the marking materials and form images on media.

It is becoming increasingly desirable to produce printing apparatuses with environmentally-friendly, "Green"-enabling printing technologies. One goal of green printing is to reduce power consumption by the printing apparatuses. In some printing apparatuses, a substantial portion of the power supplied to these apparatuses is consumed by a thermal fixing device that supplies thermal energy to fix marking material onto media. Certain thermal fixing devices, such as laser printers, can consume significant power to achieve printing and "archival-level" image permanence. For example, in a monochrome laser printer operated under typical weekly print use, using prescribed energy-saving conditions, the marking engine including a thermal fixing device may typically consume about 6,000 kW/week or more power.

Accordingly, it is desirable to reduce the amount of energy consumed on a print basis by fixing devices in printing apparatuses. Improvements in reducing fixing device power consumption, such as instant-on features, can reduce standby power, and low-melt marking materials can reduce the fixing device set temperature. By using instant-on technology in printing apparatuses, very little power may be consumed in the stand-by mode, resulting in a significant reduction in power consumption in such apparatuses. It is desirable, however, to further reduce total power consumption in printing apparatuses by reducing the amount of power used by the fixing devices in these apparatuses to produce prints.

Apparatuses useful in printing, and methods of fixing marking materials onto media in apparatuses useful in printing, are provided that enable reduced power consumption during print jobs. Embodiments of the apparatuses include two fixing devices; namely, a first, low-power fixing device, and a second fixing device. The first fixing device is operable to fix marking materials onto media by the application of pressure. Embodiments of the first fixing device do not include a thermal energy source that actively heats any surface of the first fixing device that contacts, and applies pressure to, media fed to the first fixing device. The first fixing device can be referred to as a "non-thermal" fixing device.

The second fixing device is operable to fix marking materials onto media by supplying thermal energy to the marking materials. The second fixing device can be referred to as a "thermal" fixing device. In embodiments, thermal energy and pressure can be applied to the marking material via one or more surfaces of the second fixing device that contact media fed to the second fixing device. In other embodiments, the second fixing device can include at least one thermal energy source that is operable to provide non-contact heating of marking materials on media.

In embodiments of the apparatuses useful in printing and methods of fixing marking materials onto media, marking materials can be fixed onto the media by selectively feeding the media to only one of, or to both of, the first fixing device and the second fixing device, to enable non-thermal and/or thermal fixing of the marking material.

The fixing of marking materials onto media using applied pressure with the first fixing device produces prints with a fix level that is sufficient for common uses of prints. The thermal fixing of marking materials provides longer-term, "archival" image permanence of images. Embodiments of the first fixing device have very low power consumption, making them environmentally-friendly. The provision of both a non-thermal fixing device and a thermal fixing device in one apparatus useful in printing allows users of the apparatuses to select between producing documents with pressure-fixed images with very low power consumption for various "non-archival" uses, and producing documents with thermally-fixed images of archival quality.

FIG. 1 depicts an exemplary embodiment of a first fixing device 100 that can be used in embodiments of the apparatuses useful in printing. The first fixing device 100 includes a first roll 150 and a second roll 160. The first roll 150 includes an outer surface 152 and the second roll 160 includes an outer surface 162. The outer surfaces 152, 162 form a nip 126. The outer surface 152 is shown spaced from the outer surface 162 while a medium 131 passes through the nip 126.

In embodiments, the outer surface 152 of the first roll 150 and the outer surface 162 of the second roll 160 are comprised of a hard, non-deformable material, such as a ceramic or metallic material. The first roll 150 and second roll 160 can apply a high force, F, and high pressure to fix marking material onto media. The force F can be provided by one or more springs, or the like, operatively connected to the first roll 150 and/or second roll 160. Typically, the first roll 150 and second roll 160 can exert a pressure of about 1,000 to about 10,000 psi to media at the nip 126. The amount of pressure that is applied can be determined, e.g., based on the type of marking material on the media.

In embodiments, the first fixing device 100 does not include a thermal energy source that actively heats the outer surface 152 of the first roll 150 or the outer surface 162 of the second roll 160. For example, the first fixing device 100 does not include a thermal energy source located internal to either of the first roll 150 or second roll 160, or a thermal energy source located external to the first roll 150 or second roll 160, to actively heat the outer surface 152 or the outer surface 162 by conductive, radiative or convective heat transfer modes. In the embodiments, the outer surfaces 152, 162 are at approximately the temperature of the portion of the apparatus at which the first fixing device 100 is provided. This temperature can be ambient temperature, or a temperature above ambient temperature due to heating effects from other components of the apparatus, such as electronic components. Some minor amount of heating of the outer surfaces 152, 162 may occur from contact with media/marking material at a temperature higher than that of the outer surfaces 152, 162 at the nip 126.

Depending on the specific marking material that is used to form images, the minimum amount of pressure that can achieve sufficient fixing at the first fixing device 100 can vary. For example, a pressure of about 2,500 psi may be sufficient to fix images with certain toner materials, such as polymer blends of hard and soft resins, or material designs with soft centers and hard shells. Conventional toner materials used for printing can typically need significantly higher mechanical force, depending on the type of media used. It is desirable to cause the toner to yield under pressure and adhere without damaging the media.

The medium 131 shown passing through the nip 126 in process direction P carries a marking material 123 applied to the medium 131. The medium 131 can be a coated or uncoated paper sheet, for example. As the marking material 123 moves through the nip 126, pressure is applied to the marking material by the first roll 150 and second roll 160 to fix the marking material and produce a pressure-fixed image 135. The pressure-fixed image 135 is desirable for documents that may be retained for only a short amount of time, for example.

Pressure fixing of marking materials onto media in the first fixing device 100 can provide advantages over thermal fixing. A desirable advantage of pressure fixing over thermal fixing is significantly reduced power consumption. Other advantages of pressure fixing in embodiments of the first fixing device 100 include some or all of the following: no standby power consumption, instant-on capability, robust rolls, high reliability, low service costs, fast first-copy-out time, process speed insensitivity, recyclable components, reusable hardware, reduced emissions, low noise, no blowers and no roll surface edge-wear issues.

Figure 2:
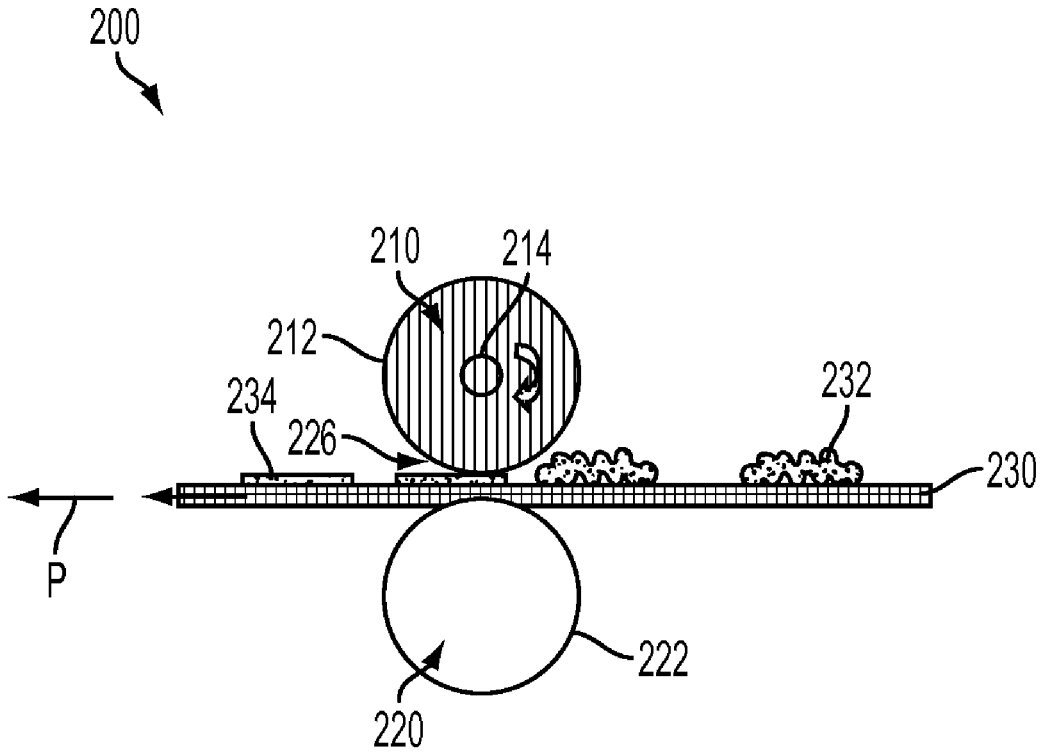
FIG. 2 depicts an exemplary embodiment of a fixing device including opposed rolls which can fix marking material onto media using thermal energy.

FIG. 2 depicts an exemplary embodiment of a second fixing device 200 that can be used in embodiments of the apparatuses useful in printing to provide thermal fixing. The second fixing device 200 includes a fixing roll 210 and a pressure roll 220. The fixing roll 210 includes an outer surface 212 and the pressure roll 220 includes an outer surface 222. The outer surfaces 212, 222 form a nip 226. The outer surface 212 is shown spaced from the outer surface 222 while a medium 230 passes through the nip 226. In embodiments, the outer surface 212 and/or the outer surface 222 can be comprised of an elastically deformable material. For example, the outer surface 212 can be conformable and the outer surface 222 can be harder than the outer surface 212 and non-conformable. In such embodiments, when the outer surfaces 212, 222 are in contact with each other, at least one of these surfaces is elastically deformed.

In the thermal fixing device 200, the outer surface 212 of the fixing roll 210 is heated. In the illustrated embodiment, a heating element 214 is disposed inside of the fixing roll 210 for heating the outer surface 212 to a sufficiently-high temperature for fixing marking materials onto media fed to the nip 226. The heating element 214 can be one or more heating lamps, or the like. In other embodiments, the outer surface 212 can be heated additionally, or alternatively, by an external heat source (not shown) via conduction, radiation and/or convection. The outer surface 212 can typically be heated to a temperature of about 150° C. to about 200° C. to thermally fix marking material onto media. For example, the temperature of the outer surface 212 can be sufficiently-high to fix toner onto coated and uncoated paper. In embodiments, the outer surface 222 of the pressure roll 220 can optionally be heated by an internal and/or external thermal energy source.

The medium 230 shown passing through the nip 126 in process direction P carries an applied marking material 232. As the medium 230 moves through the nip 226, heat and pressure are applied to the marking material by the fixing roll 210 and pressure roll 220 to produce a thermally-fixed image 234. The thermally-fixed image 234 is desirable for documents that are intended to be retained for an extended amount of time, e.g., more than one day. Such images can be described as having "archival image permanence."

Figure 3:
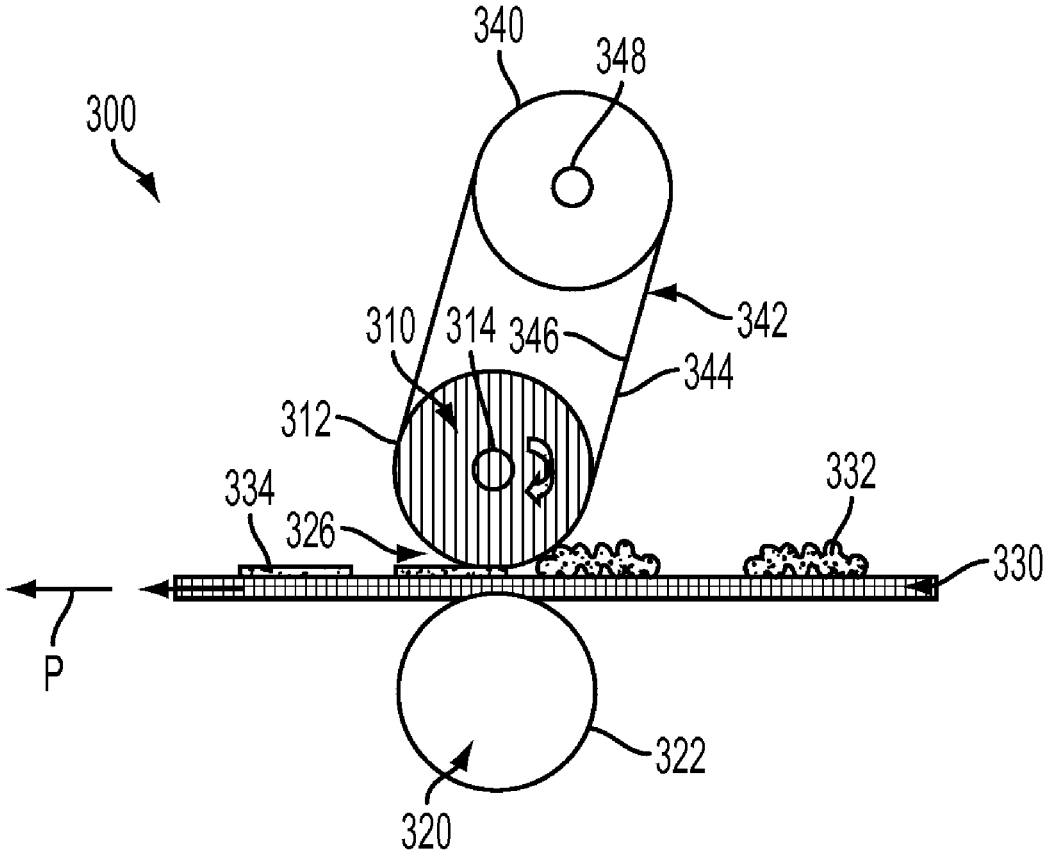
FIG. 3 depicts an exemplary embodiment of a fixing device including a roll and a belt which can fix marking material onto media using thermal energy.

FIG. 3 depicts another exemplary embodiment of a second fixing device 300 that can be used in embodiments of the apparatuses useful in printing. The second fixing device 300 includes a fixing roll 310, pressure roll 320, internal roll 340, and a fixing belt 342 supported on the fixing roll 310 and internal roll 340. The fixing roll 310 includes an outer surface 312 and the pressure roll 320 includes an outer surface 322, which form a nip 326. The outer surface 312 is shown spaced from the fixing belt 342 while a medium 330 passes through the nip 326. In embodiments, the outer surface 312 and/or the outer surface 322 can be comprised of an elastically deformable material. In such embodiments, when the outer surface 322 and the outer surface 344 of fixing belt 342 are in contact with each other, at least one of the outer surfaces 312, 322 is elastically deformed.

In the thermal fixing device 300, the fixing belt 342 is heated. A heating element 314 is shown disposed inside of the fixing roll 310 and a heating element 348 is disposed inside of the internal roll 340, for heating the fixing belt 342 to a desired temperature for fixing marking material onto media fed to the nip 326. Each of the heating elements 314, 348 can include one or more heating lamps, or the like. In other embodiments, the fixing belt 342 can be heated additionally, or alternatively, by an external heat source (not shown) via conduction, radiation and/or convection. The outer surface 344 can typically be heated to a temperature of about 150° C. to about 200° C. to thermally fix marking material onto media. The pressure roll 320 can optionally be internally and/or externally heated.

The medium 330 shown passing through the nip 326 in process direction P carries an applied marking material 332. As the medium 330 moves through the nip 326, heat and pressure are applied to the marking material 332 by the fixing belt 342 and pressure roll 320 to produce a thermally-fixed image 334.

Other embodiments of the second fixing devices can have different configurations, and utilize different modes of heating to heat media, than the second fixing devices 200, 300. For example, the second fixing device can be constructed to heat media using non-contact heating, such as radiant heating, flash heating, steam heating, or the like. In such embodiments, the media can be heated by radiative and/or convective heat transfer modes, without also applying mechanical pressure to the media.

Other embodiments of the second fixing device can have a free-belt nip configuration. For example, the second fixing devices can include a drive roll, such as a pressure roll, and a continuous belt supported on a stationary structure. The belt can be free-spinning about the support structure and caused to rotate by engagement with the rotating drive roll. The drive roll and belt form a nip through which the belt is rotated. A heater can be located internal to the belt for heating a portion of the belt. These second fixing devices enable reduced power consumption during fixing processes by heating only a portion of the belt, such as a portion of the belt in the region of the nip. Exemplary second fixing devices having a free belt nip configuration are disclosed in U.S. patent application Ser. No. 12/490,601, filed Jun. 24, 2009, which is incorporated herein by reference in its entirety.

Figure 4:
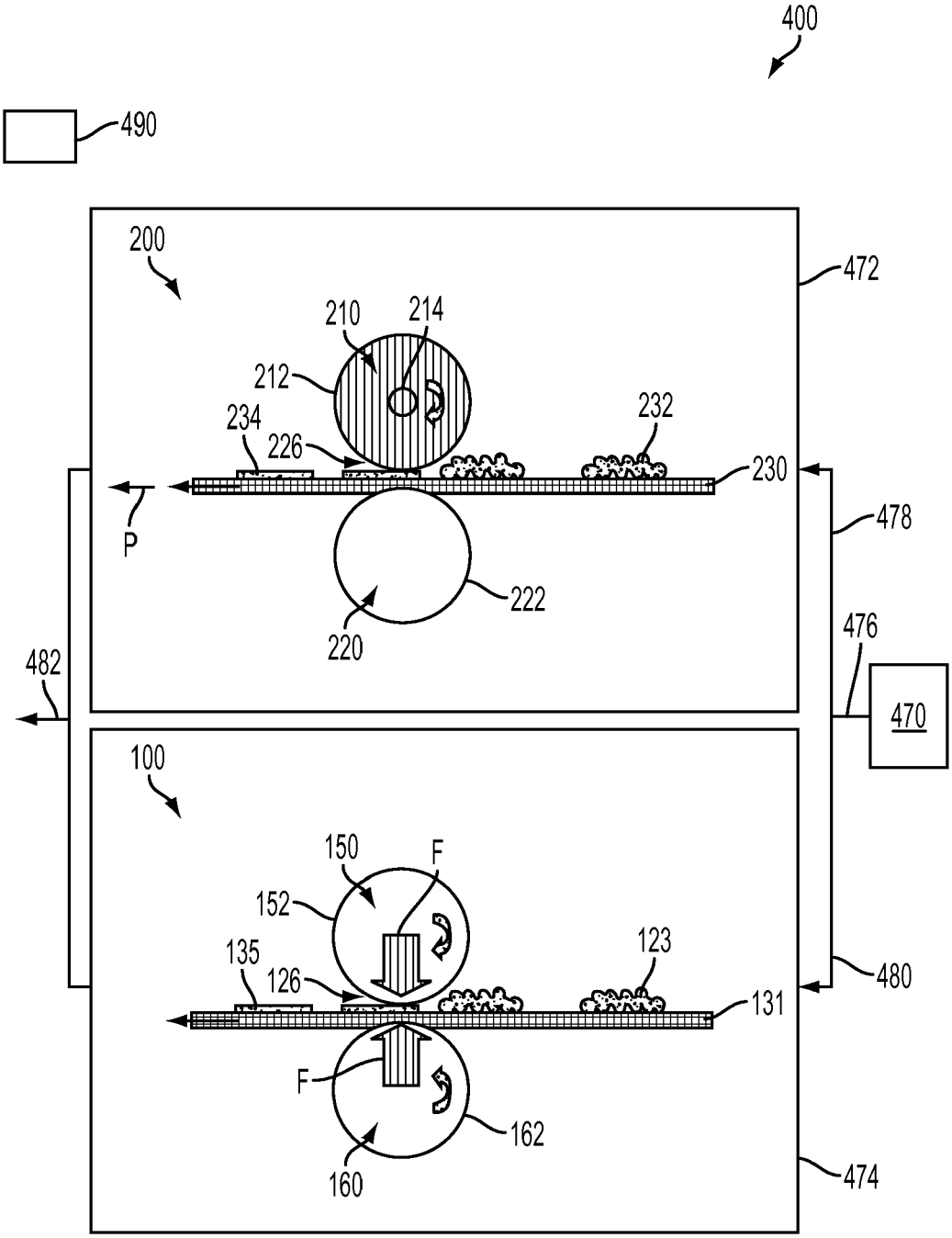
FIG. 4 depicts an exemplary embodiment of an apparatus useful in printing including two fixing devices arranged in parallel.

FIG. 4 depicts an exemplary embodiment of an apparatus 400 useful in printing, which includes a marking device 470 and both a second fixing device 472 (i.e., thermal fixing device) and a first fixing device 474 (i.e., non-thermal fixing device). In the embodiment, the second fixing device 472 and the first fixing device 474 are arranged in a parallel configuration.

The second fixing device 472 can have the same configuration as, e.g., second fixing device 200 shown in FIG. 2 or the second fixing device 300 shown in FIG. 3, and the first fixing device 474 can have the same configuration as, e.g., the first fixing device 100 shown in FIG. 1. The marking device 470 is operable to apply a marking material, such as toner, onto media. The media are conveyed along a first media path 476 and routed to either a second media path 478 along which the second fixing device 472 is disposed, or a third media path 480 along which the first fixing device 474 is disposed. After the media pass through the second fixing device 472 or the first fixing device 474, the media are routed to a fourth media path 482 for subsequent processing.

A user of the apparatus 400 can select which of the second media path 478 or the third media path 480 is used for a given print job. The apparatus 400 includes a controller 490 configured to control routing of media to the second media path 478 to achieve thermal fixing, or to the third media path 480 to achieve pressure fixing without active heating of the medium, of the marking material, depending, e.g., on the intended use of the prints. The controller 490 (or another controller (not shown)) can be connected to the thermal energy source(s) of the second fixing device 472 to control activation of the thermal energy source(s). The thermal energy source(s) can be turned OFF when thermal fixing is not selected to minimize energy consumption. The thermal energy source(s) can be activated only when thermal fixing is desired. Alternatively, the thermal energy source(s) may be maintained in a low-power mode (e.g., standby mode) when thermal fixing is not selected, but may be selected for producing latter prints.

The controller 490 (or another controller (not shown)) can selectively be programmed to make the third media path 480 through the first fixing device 474 the default path for print jobs for all media in the apparatus 400.

Embodiments of the apparatus 400 include a fix selection feature to allow users to select a pressure fix or thermal fix level for images. For example, the apparatus 400 can provide a user interface (not shown) to allow this selection. This selection can be made at the apparatus 400 or remotely from the apparatus 400, such as at a user's workstation or office. In embodiments, the apparatus 400 can include an "Archival" button, which allows a user to select a thermal fix level for images.

The first fixing device 474 consumes very low power only from mechanically driving the rolls and applying the pressure and produces a fix level that is typically sufficiently-robust for short-term usage of the prints. It has been noted that in a typical modern office environment, a significant portion of all printed documents may be discarded within several days of their production. Data and image storage is more commonly electronic in nature, allowing no paper backup to be used. These observations imply that for the intended applications of a substantial portion of all printed documents produced, non-archival image permanence is sufficient. The provision of the first fixing device 474 in the apparatus 400 allows users to receive sufficient fixing of marking materials onto media for such applications with low energy consumption.

In the apparatus 400, the provision of the second fixing device 472 allows a user to select "Archival" when thermal image fixing may be desirable for a particular print job. In embodiments, the second fixing device 472 can have instant-on fixing capabilities. In the architecture of the apparatus 400 shown in FIG. 4, this selection in turn causes unfixed prints to be routed to the second fixing device 472. Reducing use of the second fixing device 472 increases its service life, in addition to energy savings to the user resulting from the reduced use of the second fixing device 472.

Figure 5:
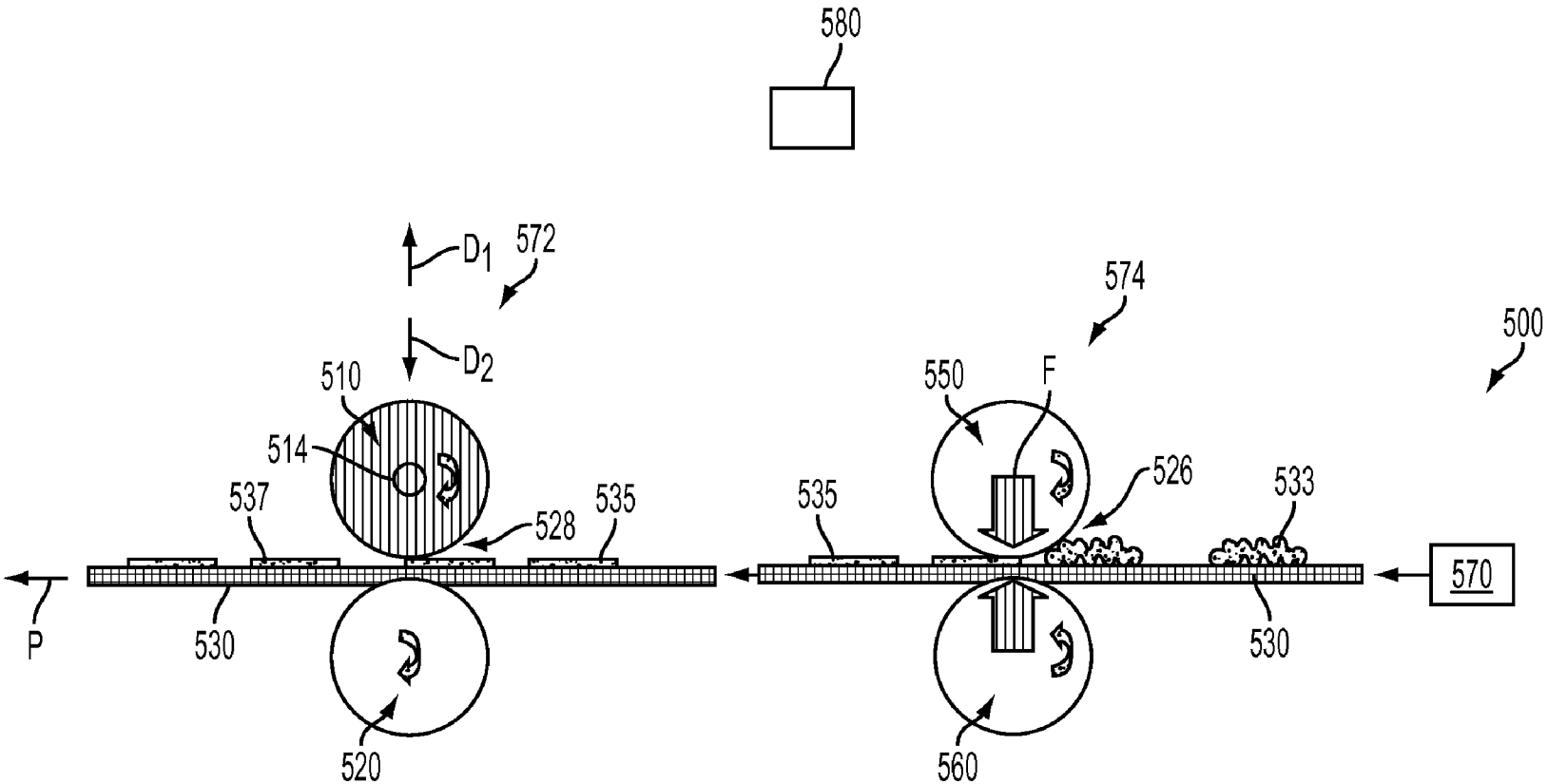
FIG. 5 depicts an exemplary embodiment of an apparatus useful in printing including two fixing devices arranged in series.

FIG. 5 depicts another exemplary embodiment of an apparatus 500 useful in printing, which includes a marking device 570 and both a second fixing device 572 (i.e., thermal fixing device) and a first fixing device 574 (i.e., non-thermal fixing device). In the embodiment, the first fixing device 574 is located upstream of the second fixing device 572 (closest to the marking device 570) in a series or tandem configuration.

The first fixing device 574 can have the same configuration as, e.g., the first fixing device 100 shown in FIG. 1, and the second fixing device 572 can have the same configuration as, e.g., the second fixing device 200 shown in FIG. 2 or the second fixing device 300 shown in FIG. 3. The marking device 570 applies a marking material, such as toner, onto media. The media are conveyed first to the first fixing device 574. A medium 530 carrying a marking material 533 is shown passing through the nip 526 of the first fixing device 574 in process direction P. As the medium 530 moves through the nip 526, pressure is applied to the marking material 533 by the first roll 550 and second roll 560 to produce a pressure-fixed image 535.

Then, the substrate 530 is passed between the fixing roll 510 and the pressure roll 520 of the second fixing device 572. In embodiments, when a user does not desire to thermally fix the pressure-fixed image 535 onto the medium 530, the second fixing device 572 can be placed in an "OFF" state by moving one of the fixing roll 510 and pressure roll 520 away from engagement with the other of the pressure roll 520 and fixing roll 510, respectively. The fixing roll 510 can be moved in direction $D_1$ by a suitable mechanism (not shown) operatively coupled to the fixing roll 510. For example, the positioning device can be connected to the shaft of the fixing roll 510. This movement of the fixing roll 510 relative to the pressure roll 520 separates the outer surfaces of these rolls by a sufficient distance that the medium 530 and pressure-fixed image 535 can pass through the second fixing device 572 without contacting the fixing roll 510 or pressure roll 530. In the embodiments, the resulting image 537 on the medium 530 is the pressure-fixed image.

When it is optionally desirable to thermally fix the pressure-fixed image 535 onto the medium 530, the second fixing device 572 can be placed in an "ON" state by moving the fixing roll 510 into engagement with the pressure roll 520 in direction $D_2$ using the positioning device to form a nip 528. The fixing roll 510 (and optionally also the pressure roll 520) is/are heated to the desired temperature by internal and/or external thermal energy sources. In this configuration, the medium 530 and the pressure-fixed image 535 are contacted by the fixing roll 510 and pressure roll 530 to thermally fix the image. In the embodiments, the resulting image 537 on the medium 530 exiting from the nip 528 is a thermally-fixed image.

A user of the apparatus 500 can select whether a pressure-fixed image or a thermally-fixed image is to be produced in a given print job. The apparatus 500 includes a controller 580 configured to control whether the fixing roll 510 and the pressure roll 520 of the second fixing device 572 are engaged to form the nip 528 to provide thermal fixing, or whether pressure-fixed images are to be produced without thermal fixing. The controller 500 (or another controller (not shown)) can be connected to the thermal energy source(s) of the second fixing device 572 to control activation and deactivation of the thermal energy source(s). The thermal energy source(s) can be turned OFF when no thermal fixing is desired to minimize energy consumption. The thermal energy source(s) can be activated only when thermal fixing is selected. Alternatively, the thermal energy source(s) may be maintained in a low power mode (e.g., standby mode) when thermal fixing is not selected, but may be selected for producing latter prints. In embodiments, the controller 580 (or another controller (not shown)) can selectively be programmed to make pressure-fixed images the default fix level for all print jobs to reduce power consumption in the apparatus 500.

The arrangement of the first fixing device 574 and the second fixing device 572 in the order shown in FIG. 5 may reduce power consumption by the second fixing device 572, by pre-conditioning with a low temperature, high-pressure, pressure fixing device. The apparatus 500 may enable overall power reduction when thermal fixing is selected.

In other embodiments of the apparatuses useful in printing, a second fixing device, such as the second fixing device 572 shown in FIG. 5, and a first fixing device, such as the first fixing device 574 shown in FIG. 5, can be arranged in series, but in a reverse order to that of the first fixing device 574 and the second fixing device 572 in the apparatus 500. In the embodiments, media from the marking device 570 pass first through the second fixing device and then through the first fixing device. The second fixing device can be selectively placed in ON and OFF states depending on whether a thermal-fixed image or a pressure-fixed image is desired by users. In embodiments, the controller 580 (or another controller (not shown)) can be programmed to make pressure-fixed images the default fix level for all print jobs in the apparatus. In the embodiments, positioning the first fixing device downstream of the second fixing device may provide additional print gloss options to users.

Embodiments of the apparatus 500 can include a fix selection feature to allow users to select a pressure fix or thermal fix level for images. For example, the apparatus 500 can provide a user interface (not shown) to allow this selection to be made at the apparatus 500 or remote from the apparatus 500, such as at a user's workstation or office. In embodiments, the apparatus 500 can include an "Archival" button, which allows a user to select a thermal fix level for images to be produced.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful in printing, comprising:

a first fixing device disposed along a first media path, the first fixing device comprising a first fixing member including a first surface and a second fixing member including a second surface forming a first nip with the first surface, wherein the first fixing device does not include a thermal energy source that actively heats the first surface or the second surface and the first fixing device is adapted to apply pressure to a medium received at the first nip;

a second fixing device disposed along a second media path, the second fixing device including at least one thermal energy source adapted to supply thermal energy to actively heat the medium at the second fixing device; and a controller configured to selectively route the medium to the first fixing device or to the second fixing device, wherein the first fixing device is disposed downstream from the second fixing device along the media path, and wherein the second fixing device comprises:

a third fixing member including a third surface;

a fourth fixing member including a fourth surface; and a positioning mechanism connected to the controller and one of the third fixing member and the fourth fixing member, the controller being configured to actuate the positioning mechanism to move the third surface relative to the fourth surface to form a second nip and to actuate the positioning mechanism to move the third surface relative to the fourth surface to unform the second nip;

wherein (i) the at least one thermal energy source comprises at least one heater adapted to heat at least one of the third surface and fourth surface, (ii) the controller is configured to activate the at least one heater to supply thermal energy when the third surface and fourth surface form the second nip and (iii) the controller is configured to deactivate the at least one heater to not supply thermal energy when the third surface and fourth surface do not form the second nip.

2. The apparatus of claim 1, wherein the controller is connected to the second fixing device and configured to activate the at least one thermal energy source to allow the medium to be heated when routed to the second media path.

3. The apparatus of claim 2, wherein:

the second fixing device comprises a third fixing member including a third surface and a fourth fixing member including a fourth surface which forms a second nip with the third surface; and the at least one thermal energy source is activated by the controller to heat at least one of the third surface and the fourth surface when the medium is routed to the second media path and fed to the second nip, the third surface and fourth surface supply thermal energy and pressure to the medium at the second nip.

4. The apparatus of claim 3, wherein:

the third fixing member comprises a third roll including the third surface;

the fourth fixing member comprises a fourth roll including the fourth surface; and the at least one thermal energy source is disposed inside of the third roll.

5. The apparatus of claim 3, wherein:

the third fixing member comprises a third roll and a belt including the third surface;

the fourth fixing member comprises a fourth roll including the fourth surface; and the at least one thermal energy source is disposed inside of the third roll.

6. The apparatus of claim 1, wherein:

the first fixing member comprises a first roll including the first surface; and the second fixing member comprises a second roll including the second surface.

7. The apparatus of claim 6, wherein:

the first surface is comprised of a metallic material or a ceramic material; and the second surface is comprised of a metallic material or a ceramic material.

8. An apparatus useful in printing, comprising:

a first fixing device disposed along a media path, the first fixing device comprising a first fixing member including a first surface and a second fixing member including a second surface which forms a first nip with the first surface, wherein the first fixing device does not include a thermal energy source that actively heats the first surface or the second surface and the first fixing device is operable to apply pressure to a medium received at the first nip;

a second fixing device arranged along the media path, the second fixing device including at least one thermal energy source adapted to supply thermal energy to actively heat the medium at the second fixing device; and a controller connected to the second fixing device and configured to selectively activate the at least one thermal energy source to supply thermal energy, wherein the first fixing device is disposed downstream from the second fixing device along the media path, and wherein the second fixing device comprises:

a third fixing member including a third surface;

a fourth fixing member including a fourth surface; and a positioning mechanism connected to the controller and one of the third fixing member and the fourth fixing member, the controller being configured to actuate the positioning mechanism to move the third surface relative to the fourth surface to form a second nip and to actuate the positioning mechanism to move the third surface relative to the fourth surface to unform the second nip;

wherein (i) the at least one thermal energy source comprises at least one heater adapted to heat at least one of the third surface and fourth surface, (ii) the controller is configured to activate the at least one heater to supply thermal energy when the third surface and fourth surface form the second nip and (iii) the controller is configured to deactivate the at least one heater to not supply thermal energy when the third surface and fourth surface do not form the second nip.

9. The apparatus of claim 8, wherein:

the first fixing member comprises a first roll including the first surface; and the second fixing member comprises a second roll including the second surface.

10. The apparatus of claim 8, wherein:

the third fixing member comprises a third roll including the third surface;

the fourth fixing member comprises a fourth roll including the fourth surface; and the at least one thermal energy source comprises at least one heater disposed inside of at least one of the third roll and fourth roll.

11. The apparatus of claim 8, wherein:

the third fixing member comprises a third roll and a fixing belt including the third surface;

the fourth fixing member comprises a fourth roll including the fourth surface; and the at least one thermal energy source comprises at least one heater disposed inside of at least one of the third roll and fourth roll.

12. A method of fixing marking material onto a medium in an apparatus useful in printing, comprising:

selectively routing a medium having marking material thereon in the apparatus useful in printing to either:

a first fixing device disposed along a first media path, the first fixing device comprising a first fixing member including a first surface and a second fixing member including a second surface which forms a first nip with the first surface, wherein the first fixing device does not include a thermal energy source that actively heats the first surface or the second surface and the first fixing device applies pressure to the marking material at the first nip to fix the marking material onto the medium when the medium is routed to the first fixing device; or a second fixing device disposed along a second media path, the second fixing device including at least one thermal energy source which supplies thermal energy to thermally fix the marking material onto the medium when the medium is routed to the second fixing device, wherein the first fixing device is disposed downstream from the second fixing device along the media path, and wherein the at least one thermal energy source is turned OFF when the medium is routed to the first fixing device.

13. The method of claim 12, comprising routing the medium to the first fixing device to fix the marking material onto the medium by applying pressure to the medium.

14. The method of claim 12, comprising routing the medium to the second fixing device to thermally fix the marking material onto the medium.

15. The method of claim 14, wherein the second fixing device applies pressure to the medium during thermal fixing of the marking material onto the medium.

16. The method of claim 14, wherein the second fixing device does not apply pressure to the medium during thermal fixing of the marking material onto the medium.

17. A method of fixing marking material onto a medium in an apparatus useful in printing, the apparatus comprising a first fixing device and a second fixing device arranged along a media path with the first fixing device, the first fixing device including a first fixing member having a first surface and a second fixing member having a second surface which forms a first nip with the first surface, wherein the first fixing device does not include a thermal energy source that actively heats the first surface or the second surface, the second fixing device including at least one thermal energy source, the method comprising:

feeding a medium having a marking material on a surface thereof along the media path to the first nip to pressure fix the marking material onto the medium;

feeding the medium along the media path to the second fixing device; and optionally supplying thermal energy from the at least one thermal energy source to the medium to thermally fix the marking material onto the medium at the second fixing device, wherein the first fixing device is disposed downstream from the second fixing device along the media path, and wherein the at least one thermal energy source of the second fixing device is turned OFF when the medium is fed to the first fixing device and thermal energy is not supplied from the at least one thermal energy source to the medium to thermally fix the marking material onto the medium at the second fixing device.

18. The method of claim 17, further comprising:

moving a third surface of the second fixing device relative to a fourth surface of the second fixing device to form a second nip;

heating at least one of the third surface and fourth surface with thermal energy supplied by the at least one thermal energy source; and supplying thermal energy from the at least one thermal energy source to the medium at the second nip to thermally fix the marking material onto the medium.

19. The method of claim 17, further comprising:

moving a third surface of the second fixing device away from contact with a fourth surface of the second fixing device; and passing the medium between the third surface and fourth surface;

wherein thermal energy is not supplied from the at least one thermal energy source to the medium to thermally fix the marking material onto the medium at the second fixing device.

20. The method of claim 17, wherein the medium is fed to the first fixing device and then to the second fixing device.

21. The method of claim 17, wherein the medium is fed to the second fixing device and then to the first fixing device.

* * * * *